US006826809B2

(12) United States Patent
Takazawa et al.

(10) Patent No.: US 6,826,809 B2
(45) Date of Patent: Dec. 7, 2004

(54) SEPARABLE BOTTOM END STOP FOR SLIDE FASTENER

(75) Inventors: Shigeyoshi Takazawa, Cheshire (GB); Mitsugu Umino, Toyama-ken (JP); Tomiyoshi Takano, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/396,159

(22) Filed: Mar. 24, 2003

(65) Prior Publication Data

US 2004/0000039 A1 Jan. 1, 2004

(30) Foreign Application Priority Data

Mar. 26, 2002 (JP) ..... 2002-084978

(51) Int. Cl.[7] ..... A44B 19/38
(52) U.S. Cl. ..... 24/433; 24/388
(58) Field of Search ..... 24/388, 433, 434

(56) References Cited

U.S. PATENT DOCUMENTS 4,244,087 A * 1/1981 Akashi ..... 24/433
4,742,603 A * 5/1988 Kasai ..... 24/433
4,870,724 A * 10/1989 Fujisaki et al. ..... 24/433
5,755,014 A * 5/1998 Yamaguchi et al. ..... 24/433
6,112,376 A * 9/2000 Akashi et al. ..... 24/433
6,481,068 B1 * 11/2002 Takasawa ..... 24/433

FOREIGN PATENT DOCUMENTS

| | | |
|---|---|---|
| EP | 0 704 177 A1 | 4/1996 |
| EP | 0 815 765 A2 | 1/1998 |
| EP | 0 992 201 A1 | 4/2000 |
| JP | 8-98707 | 4/1996 |
| JP | 10-014617 | 1/1998 |
| JP | 2000-106917 | 4/2000 |

* cited by examiner

*Primary Examiner*—Robert J. Sandy
(74) *Attorney, Agent, or Firm*—Everest Intellectual Property Law Group; Michael S. Leonard

(57) ABSTRACT

A separable bottom end stop for a slide fastener comprising a box, a box pin, and an insert pin. Protruding guide portions which protrude onto respective fastener tapes are integrally molded with respective side faces at tape-sides of the box pin and the insert pin via thin guide portions. The separable bottom end stop is formed of polyacetal resin, and a distance d between each outer side face of the box and each of the protruding guide portions and a protrusion height h of each of the protruding guide portions from a surface of each of the thin guide portions when the box pin and the insert pin are mounted into the box satisfy the equation (I): $\tan^{-1}(d/h) \geqq 33°$, where $d \neq 0$. The separable bottom end stop becomes hard to be broken with having excellent durability, despite using polyacetal resin which allows various coloring achieved easily, but is easy to be broken.

1 Claim, 3 Drawing Sheets

SEPARABLE BOTTOM END STOP FOR SLIDE FASTENER

BACKGROUND OF THE INVENTION

1. Field of the Invention

The present invention relates to a separable bottom end stop for a slide fastener comprising a box, a box pin and an insert pin, which are provided at ends of a pair of fastener stringers.

2. Description of the Related Art

There are various configurations of separable bottom end stops for a slide fastener, each separable bottom end stop being molded integrally with ends of fastener stringers using thermoplastic synthetic resin. However, a common feature in structures of the separable bottom end stops is that the box pin and the insert pin are integrally molded with one end of opposing edges of the pair of fastener stringers at least so as to be fixed thereto. In addition, usually the box is molded in a shape of a thin rectangular box, and a cross-section taken parallel to a short arm direction of the box, the short arm having a partition wall in a center of an inner side thereof, presents substantially a shape of the letter "H" turned sideways. Further, side portions of a long-arm side of the box have slit-shaped openings respectively.

Right and left spaces of the box which are defined by the partition wall, include a box pin insertion hole and an insert pin insertion hole into which the box pin and the insert pin are inserted respectively from one end of the box. Because, as mentioned above, the box pin and the insert pin are respectively fixed to the opposing edges of the pair of fastener stringers, the fastener tape portion of the each fastener stringer is also inserted into the slit-shaped opening when the box pin or the insert pin is inserted into the respective insertion hole of the box.

In recent years, as disclosed in Japanese Patent Application Laid-Open Nos. 8-98707, 10-14617 and 2000-106917, protruding guide portions which extend substantially parallel with respect to the insert pin and the box pin are molded integrally with the inner face of the fastener tape side of the insert pin and the box pin, via thin guide portions. The thin guide portions and the protruding guide portions allow the insertion operation of the insert pin and the box pin into the respective insertion holes in the box to be carried out easily. In addition, with ensuring secure and smooth insertion of the insert pin and the box pin, the thin guide portions and the protruding guide portions have a function for stabilizing the separable bottom end stop and the attaching portion for said bottom end stop.

It is to be noted that in order to ensure flexibility of the thin guide portions between the protruding guide portions, and the box pin and the insert pin, nylon which is very flexible, is often used as a material for forming the separable bottom end stop. However, increased demand for matching with diversification of fashion in recent years and various colors spreads even to a field of slide fasteners and other types of fasteners. In addition, a rapid action to the demand has been required.

However, conventionally, nylon is not used so much as the material for forming the slide fastener except for the separable bottom end stop, and there is a limit to the amount used. Additionally, it is difficult for nylon to meet the demand for matching with various colors, and further, nylon has high hygroscopic property, so managing the material is difficult.

SUMMARY OF THE INVENTION

This invention was developed with the foregoing present situation in view, and a specific object of the invention is to provide a separable bottom end stop for a slide fastener having an excellent durability with a material used for various purposes in the relevant field and being colored easily.

Firstly, the inventors set out to select a material that would replace nylon as a thermoplastic synthetic resin material of the separable bottom end stop for a slide fastener. As disclosed in the publications listed above, polyacetal resins are used much in slide fasteners as well as in other types of fasteners. Polyacetal resin is hard and easily handled, and is easy to manage because it has low water absorptivity and the quality of it does not alter with time. In addition, molding can be carried out easily and various colors can be realized when using polyacetal resin.

However, the polyacetal resin is hard and stiff, but it is also brittle. As a result, the box pin, the insert pin and the protruding guide portions individually tend to break easily and further, adhesive strength with other material is low and stripping tends to occur easily. Generally, before the separable bottom end stop is molded integrally with a fastener tape, a reinforcing film or a tape made from other flexible material is adhered to a region of the fastener tape where the separable bottom end stop is molded. Therefore, in the case where polyacetal resin is used to form the separable bottom end stop, the separable bottom end stop itself can be stripped from the fastener tape easily.

To solve the problem of easy stripping, if a large number of holes are formed in the region of the fastener tape where the separable bottom end stop is molded, the resin of the material passes through the holes and connects front and rear surfaces of the fastener tape upon molding. As a result, jointing strength is increased so that stripping can be prevented. At the same time, breakage of the box pin and the insert pin can be avoided. However, especially when the box pin is inserted into the insert hole in the box and fixed thereto, or when the insert pin is inserted into the insert hole in the box or removed therefrom, the box pin or the insert pin is often bent with respect to the box around the thin guide portion between the protruding guide portion and the box pin or the insert pin. If degree of the bending is large, the thin guide portion will break easily. If the thin guide portion break, the configuration of the separable bottom end stop cannot be kept stable and the separating operation also becomes difficult.

According to the invention, the past problems are solved and at the same time, inconveniences resulting from use of polyacetal resin material are eliminated. The basic structure of the invention is a separable bottom end stop for a slide fastener comprising a box, a box pin, and an insert pin, in which protruding guide portions which protrude onto respective fastener tapes are integrally molded with side faces at the tape-side of the box pin and the insert pin, via thin guide portions, wherein the separable bottom end stop is formed of a polyacetal resin, and a distance d between each of outer side faces of the box and each of the protruding guide portions when the box pin and the insert pin are mounted into the box, and a protrusion height h of each of the protruding guide portions from a surface of each of the thin guide portions satisfy the following equation (I):

$$\tan^{-1}(d/h) \geqq 33^\circ \qquad \text{(I)}$$

where $d \neq 0$.

If the value of $\tan^{-1}$ (d/h) is less than 33°, there will be a large degree of bending around the thin guide portion between the protruding guide portion and the box pin or the insert pin, and thus the thin guide portion will break easily. If the value of $\tan^{-1}$ (d/h) exceeds 33°, the protruding guide portion will abut the side face of the box and there will be no further bending thus preventing breakage. Meanwhile, it is to be noted that, assuming that the distance d between each of the outer side surfaces of the box and each of the protruding guide portions is 0, that is, assuming that width dimension of the thin guide portion is made 0, it becomes difficult to insert the box pin and the insert pin into the insertion holes of the box and thus difficulty of the operation is increased. It is to be noted that in a conventional type separable bottom end stop made of nylon, the value of $\tan^{-1}$ (d/h) is 12° and the value is extremely small.

DESCRIPTION OF THE PREFERRED EMBODIMENTS

A typical embodiment of a separable bottom end stop for a slide fastener according to the invention will be described in detail with reference to the accompanying drawings.

Usually, in the separable bottom end stop for the slide fastener made of thermoplastic synthetic resin material, a box pin and an insert pin is integrally molded with one end portion of a pair of fastener stringers 7 by injection molding at first and then, a box is molded independently. The box and the box pin have an engagement portion by which they are engaged and fixed each other when the box pin is inserted into the box pin insertion holes of the box.

Figure 1:
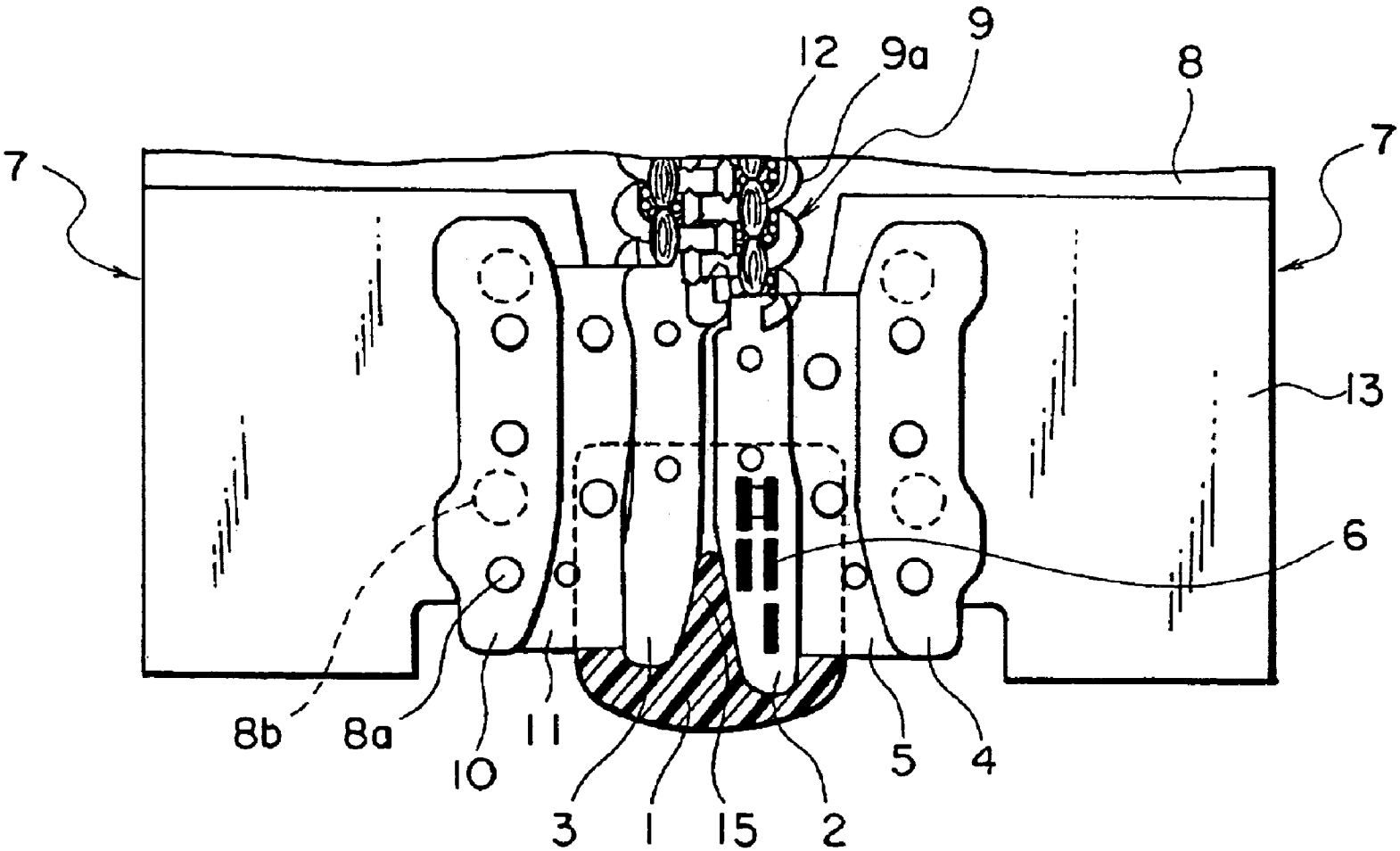
FIG. 1 is a partial plan view of a slide fastener in which a portion of a separable bottom end stop of the invention is partially cut.

FIG. 1 is a partial plan view of the slide fastener of the invention in which a part of the separable bottom end stop is cut. It shows an engagement state in which the box pin 2 is inserted into the box 1 and integrated therewith.

In order to mold the box pin 2 and the insert pin 3 with end portions of the right and left fastener stringers 7, a thermoplastic resin film or thin cloth tape is first adhered to an end portion of a fastener tape 8, or thermoplastic synthetic resin is permeated through the end portion of the fastener tape to thereby form a reinforcement portion 13. Further, the box pin 2 or the insert pin 3 is generally molded by injection molding on both front and rear surfaces of an attachment side for fastener elements of the reinforcement portion 13.

According to the invention, only polyacetal resin is used as the material for forming the box 1, the box pin 2 and the insert pin 3. Each of the box pin 2 and the insert pin 3 comprises a pin portion having a cross section in which trapezoids are overlapped each other at the bottom sides thereof. The box pin 2 are the insert pin 3 are molded such that each of which has substantially the same height of coil-like fastener elements 9, one side of which is substantially aligned with outer side of inverse portions 9*a* of the coil shaped fastener elements 9, and the other outer side edge of which is substantially align with the side edge of the fastener tape 8. Also, thin guide portions 5 and 11 are formed from each inner side face of the box pin 2 and the insert pin 3 to the fastener tape side so as to have a distance d within which thin flanges of a slider (not shown) can slide freely. In addition, protruding guide portions 4, 10 comprising small plates, which are thinner than the box pin 2 and the insert pin 3 which protrude from front and rear surfaces of the fastener 8, are molded at the side faces of the thin guide portions 5 and 11 so as to be parallel with the box pin 2 and the insert pin 3 respectively. The protruding guide portions 4, 10 have a height less than that of the box pin 2 and the insert pin 3, and have a height higher than that of the thin guide portions 5 and 11 by the dimension h.

An upper surface of a first half of the box pin 2 has a plurality of small projections 6 formed to project therefrom. After the box pin 2 is inserted into the box pin insertion hole in box 1, these small projections 6 are melted with the box 1 by ultrasonic wave heating, and the box pin and the box are joined together so as to be integral. Front end portions of the box pin 2 and the insert pin 3 are slightly bent in a respective inner direction and they guide the outer face of the box 1 and also the outer face of a flange (not shown) of the slider.

As understood from FIG. 1, an exterior of the box 1 is a substantially square thin box and slits 14 through which the thin guide portions 5 and 11 respectively are inserted, are formed in both side walls of the box 1. Also, a partition wall 15 is formed in a center of the box 1 to define the box pin insertion hole 16 and the insert pin insertion hole 17 at the left and right sides thereof. It is to be noted that several rows of small projecting portions are formed at a top portion of the box pin insertion hole 16 of the box 1 such that the box and the box pin 2 can be joined together. In this case, even when small projections 6 are not formed on the upper surface of the box pin 2, joining of the box 1 with the box pin 2 can be carried out by ultrasonic wave heating.

The separable bottom stop is operated as follows. First the slider (not shown) is slid and attached to the box 1 which is fixed to one of the fastener stringers 7. Next the insert pin 3 which is mounted on the other fastener stringer 7 is inserted from a shoulder of the slider. After the insert pin 3 has been inserted up to the insert pin insertion hole 17 in the box 1, the slider is pulled upward in the closing direction and the slide fastener is closed.

For separating and opening the slide fastener, the slider (not shown) is slid and attached to the to the box 1 and then, the insert pin 3 is pulled out from the box 1 and the slider, thereby the slide fastener can be separated into the right and left fastener stringers 7, 7.

Figure 2:
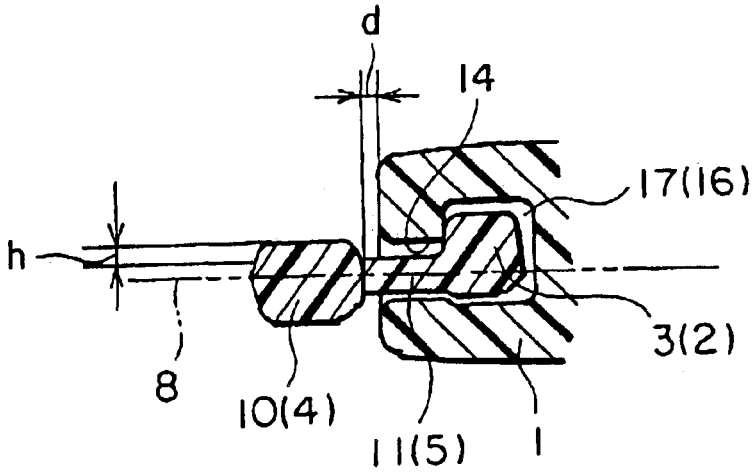
FIG. 2 is a partial sectional view illustratively showing the separable bottom end stop in a normal state.

The most characteristic feature of the invention is that the material used for forming the separable bottom end stop for the slide fastener, in which the protruding guide portions 4, 10 which protrude onto respective fastener tapes are integrally molded with respective side faces at the tape-side of the box pin 2 and the insert pin 3 via the thin guide portions 5 and 11, is polyacetal resin; and as shown in FIG. 2, the distance d between each of the outer side faces of the box 1 and the protruding guide portion 10(4) when the insert pin 3 (box pin 2) is mounted into the box 1, and a protrusion height h of the protruding guide portion 10(4) from the surface of the thin guide portion 11(5) satisfy the relationship $\tan^{-1}$ (d/h)≧33°.

This relative equation was derived as a result of repeated experimentation in an effort to physically eliminate the tendency for breakage with using polyacetal resin which is formed from ordinary material without any special change of the material, based on the fact that polyacetal resin allows various colors, reduces the changes in the quality of the material, has sufficient rigidity and is easy to be operated, but has a characteristic defect to break easily.

Figure 3:
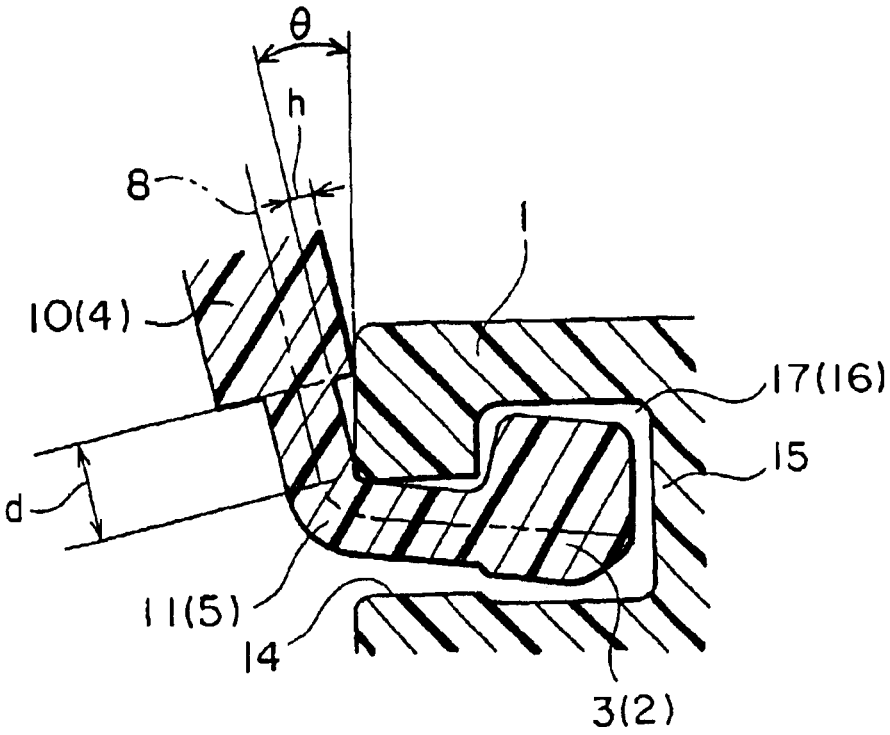
FIG. 3 is a partially expanded sectional view illustratively showing a bending limit for a separable bottom end stop.

FIG. 3 schematically shows the bent state of the thin guide portion 11(5), as well as the relationship at that time, between the distance d from the outer side face of the box 1 to the protruding guide portion 10(4) and the projection height h from a surface of the thin guide portion 11(5) to a surface of the protruding guide portion 10(4). At this time, the extent of curvature when the thin guide portions 11(5) is curved in the direction of the outer side face of the box 1 has its limit when an inner linear ridge portion of the protruding guide portion 10(4) which is exposed at the outer portion is abutting upon the outer side face of the box 1. Even in a state where there is no bending, the dimension in the tape-width direction of the thin guide portion 11(5) is such that even when the thin guide portion 11(5) is bent, the protruding guide portion 10(4) is not long enough to bend onto the surface side of the box 1.

Figure 4:
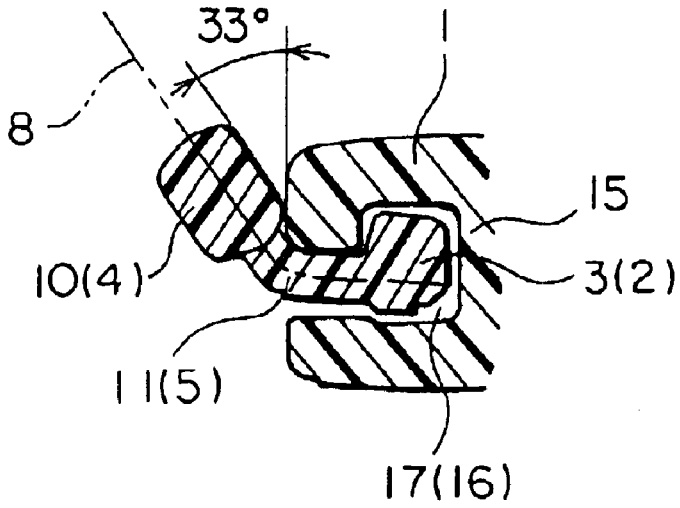
FIG. 4 is a partially expanded sectional view illustratively showing a bending limit for the separable bottom end stop of the invention.
Figure 5:
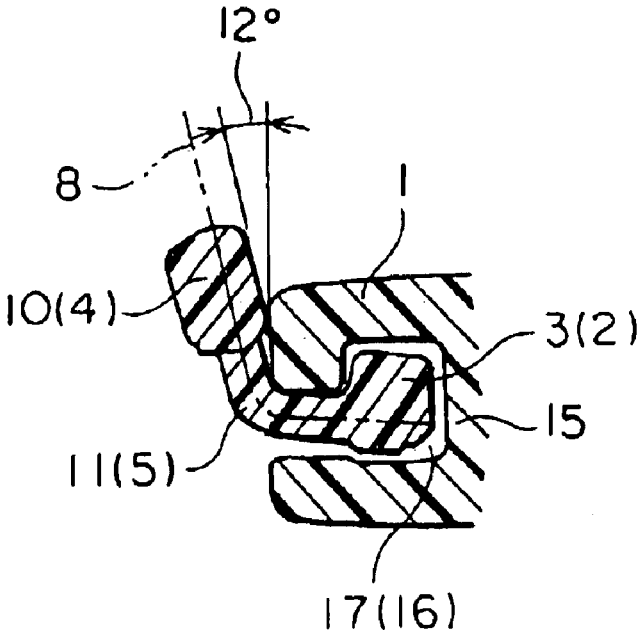
FIG. 5 is a partially expanded sectional view illustratively showing a bending limit of a separable bottom end stop of a prior art.

FIG. 4 illustratively shows the limit for bending of the separable bottom end stop of the invention, which is formed of polyacetal resin. FIG. 5 is for comparison to FIG. 4, and illustratively shows the limit for bending of the separable bottom end stop of the prior art, which is formed of nylon. In these drawings, it is clear that because the polyacetal resin is used for the separable bottom end stop of the invention, a value of $\tan^{-1}$ (d/h) which is the bending limit, that is, an angle θ formed by the outer side face of the box 1 and the surface of the thin guide portion 11(5) when the inner ridge portion of the protruding guide portion 10(4) abuts on the outer side face of the box 1, is 33°. However, if the angle θ has a normal value of 12° or lower, which is extremely low when compared to 33°, breakage does not occur in the conventional separable bottom end stop made of nylon, because the nylon is flexible.

In the invention, setting the value θ at 33° or more allows unexpected effects to be achieved. That is, by satisfying the equation above, when the dimensions of the box 1, the insert pin 3 (box pin 2) and the protruding guide portion 10(4) are the same as that of the device of the prior art, it is possible for the width dimensions of the thin guide portion 11(5) in the tape-width direction to be smaller. As a result, the total dimension of the separable bottom end stop in the tape width direction can be made smaller. With the width dimension of the separable bottom end stop of the prior art, when the slide fastener is sewed to an attachment object, the machine needle touches a portion of the protruding guide portion 10(4), and there is a problem that breakage tends to occur at this portion. However, because the entire dimension in the tape-width direction of the separable bottom end stop is smaller, the machine needle no longer touches any portion of the protruding guide portions, and thus breakage is no longer a concern.

However, the width dimension d between the outer side face of the box 1 and the surface of the thin guide portion 11(5) must be greater than 0. If that value of the dimension d is zero or less, when the box pin 2 is mounted and fixed to the box 1, or when the insert pin 3 is inserted into the insert pin insertion hole 17 of the box 1, the width dimension of the thin guide portion 11(5) in the tape-width direction becomes too small, and thus the thin guide portion 11(5) cannot be inserted through the slit 14 which is formed on the side portion of the box 1, or it may become impossible for the insertion of the box pin 2 and the insert pin 3 into the box 1 to be carried out smoothly.

Other improvements are also achieved by this embodiment of the invention. For example, measures were taken to prevent the tendency for stripping from its occurring, which is caused by the lack of adhesive power of polyacetal resin. That is, as shown in FIG. 1, reference symbol 8*a* denotes each of a plurality of small holes formed in a molding portion of the separable bottom end stop in the conventional fastener tape 8. When the separable bottom end stop is being molded, the molten resin is penetrated through from the front to the rear of the fastener tape 8 via the small holes and these small holes 8*a* bridge the insert pin 3 (box pin 2), the protruding guide portion 10(4), and the thin guide portion 11(5) which are molded to the molding portion of the separable bottom end stop in the tape 8, and ensure strength with respect to stripping. In order to further increase the strength with respect to stripping, as is shown by the broken lines in FIG. 1, in addition to the small holes 8*a*, more small holes 8*b* are also formed.

As described above, the invention makes it possible to provide a separable bottom end stop for a slide fastener, which eliminates tendency for breakage to occur and has excellent durability, while having other excellent physical properties; despite using polyacetal resin which is a material that tends to break, to form the separable bottom end stop.

What is claimed is:

1. A separable bottom end stop for a slide fastener, the bottom end stop comprising a box, a box pin, and an insert pin, wherein protruding guide portions which protrude onto respective fastener tapes are integrally molded with side faces at tape-sides of the box pin and the insert pin via thin guide portions, the separable bottom end stop is formed of polyacetal resin, and a distance d between each of outer side faces of the box and each of the protruding guide portions when the box pin and the insert pin are mounted into the box, and a protrusion height h of each of the protruding guide portions from a surface of each of the thin guide portions satisfy the following equation $$\tan^{-1}(d/h) \geqq 33^\circ \text{ where } d \neq 0 \quad \text{(I).}$$

* * * * *